US006775578B2

(12) United States Patent
Couet et al.

(10) Patent No.: US 6,775,578 B2
(45) Date of Patent: Aug. 10, 2004

(54) OPTIMIZATION OF OIL WELL PRODUCTION WITH DEFERENCE TO RESERVOIR AND FINANCIAL UNCERTAINTY

(75) Inventors: Benoit Couet, Weston, CT (US); Robert Burridge, Boston, MA (US); David Wilkinson, Ridgefield, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 225 days.

(21) Appl. No.: 09/930,935

(22) Filed: Aug. 16, 2001

(65) Prior Publication Data

US 2002/0100584 A1 Aug. 1, 2002

Related U.S. Application Data

(60) Provisional application No. 60/229,680, filed on Sep. 1, 2000.

(51) Int. Cl.[7] ..... G05B 13/00

(52) U.S. Cl. ..... 700/28; 700/29; 703/10; 166/268

(58) Field of Search ..... 703/10; 700/28, 700/29, 30, 31; 705/7; 706/19; 166/266, 268

(56) References Cited

U.S. PATENT DOCUMENTS

| | | | | | |
|---|---|---|---|---|---|
| 4,181,176 | A | * | 1/1980 | Frazier | 166/252.1 |
| 5,301,101 | A | * | 4/1994 | MacArthur et al. | 700/36 |
| 5,862,381 | A | * | 1/1999 | Advani et al. | 717/125 |
| 5,924,048 | A | * | 7/1999 | McCormack et al. | 702/13 |
| 5,930,762 | A | * | 7/1999 | Masch | 705/7 |
| 6,236,894 | B1 | * | 5/2001 | Stoisits et al. | 700/28 |

OTHER PUBLICATIONS

Harald H. Soleng, "Oil Reservoir Production Forecasting with Uncertainty Estimation Using Genetic Algorith," IEEE Proceeding of 1999, pps. 1217–1223, vol. 2, 1999.*

Harry M. Markowitz, "Portfolio Selection," John Wiley & Sons Inc., New York, 1959.*

Z. Fathi et al. "Use of Optimal Control Theory for Computing Optimal Injection Policies for Enhanced Oil Recovery". Automatica, vol. 22, No. 1 (1986), pp. 33–42.

A. S. Lee et al. "A Linear Programming Model for Scheduling Crude Oil Production". Petroleum Transactions, AIME, vol. 213 (1958), pp. 389–392.

D. G. Luenberger. Investment Science, Oxford University Press (1998).

W. F. Ramirez. "Application of Optimal Control Theory to Enhanced Oil Recovery". Elsevier, Developments in Petroleum Science 21 (1987).

G. W. Rosenwald et al. "A Method for Determining the Optimum Location of Wells in a Reservoir Using Mixed Integer Programming". Society of Petroleum Engineers Journal, vol. 14, No. 1 (1974), pp. 44–54.

B. Sudaryanto et al. "Optimization of Displacement Efficiency Using Optimal Control Theory". 6th European Conf. on the Mathematics of Oil Recovery (1998).

* cited by examiner

*Primary Examiner*—Anthony Knight
*Assistant Examiner*—Aaron Perez-Daple
(74) *Attorney, Agent, or Firm*—David P. Gordon; William B. Batzer; John J. Ryberg

(57) ABSTRACT

Methods for optimization of oil well production with deference to reservoir and financial uncertainty include the application of portfolio management theory to associate levels of risk with Net Present Values (NPV) of the amount of oil expected to be extracted from the reservoir. Using the methods of the invention, production parameters such as pumping rates can be chosen to maximize NPV without exceeding a given level of risk, or, for a given level of risk, the minimum guaranteed NPV can be predicted to a 90% probability. An iterative process of generating efficient frontiers for objective functions such as NPV is provided.

8 Claims, 8 Drawing Sheets

OPTIMIZATION OF OIL WELL PRODUCTION WITH DEFERENCE TO RESERVOIR AND FINANCIAL UNCERTAINTY

This application claims the benefit of provisional application serial No. 60/229,680 filed Sep. 1, 2000, the complete disclosure of which is hereby incorporated by reference herein.

BACKGROUND OF THE INVENTION

1. Field of the Invention

The invention relates to oil well production. More particularly, the invention relates to methods for optimizing oil well production.

2. State of the Art

The crude oil which has accumulated in subterranean reservoirs is recovered or "produced" through one or more wells drilled into the reservoir. Initial production of the crude oil is accomplished by "primary recovery" techniques wherein only the natural forces present in the reservoir are utilized to produce the oil. However upon depletion of these natural forces and the termination of primary recovery, a large portion of the crude oil remains trapped within the reservoir. Also many reservoirs lack sufficient natural forces to be produced by primary methods from the very beginning. Recognition of these facts has led to the development and use of many enhanced oil recovery techniques. Most of these techniques involve injection of at least one fluid into the reservoir to force oil towards and into a production well.

Typically, one or more production wells will be driven by several injector wells arranged in a pattern around the production well(s). Water is injected through the injector wells in order to force oil in the "pay zone" of the reservoir towards and up through the production well. It is important that the water be injected carefully so that it forces the oil toward the production well but does not prematurely reach the production well before all or most of the oil has been produced. Generally, once water reaches the production well, production stops. Over the years, many have attempted to calculate the optimal pumping rates for injector wells and production wells in order to extract the most oil from a reservoir.

An oil reservoir can be characterized locally using well logs and more globally using seismic data. However, there is considerable uncertainty as to its detailed description in terms of geometry and geological parameters (e.g. porosity, rock permeabilities, etc.). In addition, the market value of oil can vary dramatically and so financial factors may be important in determining how production should proceed in order to obtain the maximum value from the reservoir.

As early as 1958, a linear programming model was proposed by Lee, A. S. and Aronovsky, J. S. in "A Linear Programming Model for Scheduling Crude Oil Production," J. Pet. Tech. Trans. A.I.M.E. 213, pp. 51–54. More recently, in 1974, the optimum number and placement of wells has been calculated using mixed integer programming. See, Rosenwald, G. W. and Green, D. W., "A Method for Determining the Optimum Location of Wells in a Reservoir Using Mixed Integer Programming," Society of Petroleum Engineers of AIME Journal, Vol. 14, No. 1, February 1974, p 44–54. In the 1980s work was done regarding the optimum injection policy for surfactants. This work maximized the difference between gross revenue and the cost of chemicals in a one-dimensional situation but with a sophisticated set of equations simulating multiphase flow in a porous medium.

See, Fathi, Z. and Ramirez, W. F., "Use of Optimal Control Theory for Computing Optimal Injection Policies for Enhanced Oil Recovery," Automatica 22, pp. 33–42 (1984) and Ramirez, W. F., "Applications of Optimal Control Theory to Enhanced Oil Recovery," Elsevier, Amsterdam (1987). Most recently, in the 1990s, the Pontryagin Maximum Principle for Autonomous Time Optimal Control Problems and Constrained Controls has been applied to optimize oil recovery. See, Sudaryanto, B., "Optimization of Displacement Efficiency of Oil Recovery in Porous Media Using Optimal Control Theory," Ph.D. Dissertation, University of Southern California, Los Angeles (1998) and Sudaryanto, B. and Yortsos, Y. C., "Optimization of Displacement Efficiency Using Optimal Control Theory", European Conference on the Mathematics of Oil Recovery, Peebles, Scotland (1998). Because of the linear dependence of the Hamiltonian on the control variables, if the variables are constrained to lie between upper and lower bounds, the Pontryagin Maximum Principle implies that optimal controls display a "bang—bang behavior", i.e. each control variable staying at one bound or the other. This leads to an efficient algorithm.

All of these approaches to optimizing oil recovery are subject to various uncertainties. Some of these uncertainties include the accuracy of the mathematical model used, the accuracy and completeness of the data, financial market fluctuations, the possibility that new information will affect present measurements, and the possibility that new technology will affect the collection and/or interpretation of data. Choosing a course of action will invariably involve some risk.

SUMMARY OF THE INVENTION

It is therefore an object of the invention to provide methods for optimizing oil recovery from an oil reservoir.

It is also an object of the invention to provide methods for optimizing oil recovery from an oil reservoir which takes into account both deterministic and stochastic factors.

It is another object of the invention to provide methods for optimizing oil recovery from an oil reservoir which account for downside risk.

It is still another object of the invention to provide methods for optimizing oil recovery from an oil reservoir which takes into account both financial as well as physical parameters.

In accord with these objects which will be discussed in detail below, the methods of the present invention include the application of portfolio management theory to associate levels of risk with Net Present Values (NPV) of the amount of oil expected to be extracted from the reservoir. Using the methods of the invention, production parameters such as pumping rates can be chosen to maximize NPV without exceeding a given level of risk, or, for a given level of risk, the NPV can be maximized with a 90% confidence level.

More particularly, the methods of the invention include first deriving semi-analytical results for a model of the reservoir. This involves setting up a forward problem and the corresponding deterministic problem. Certain simplifying assumptions are made regarding viscosity, permeability, the oil-water interface, the initial areal extent of the oil, the shape of the oil patch and its location relative to the production well. With these assumptions, the motion of the oil-water interface is derived under the influence of oil production at a central well and water injection at neighboring wells. The flow rates (pumping rates) are constrained by positive lower and upper bounds determined by the well and formation structures. The amount of oil extracted, or its NPV is optimized under the assumption that production stops when water breaks through at the producer well. According to the methods of the invention, flow rates do not change continuously. A time interval is split into a small number of subintervals during which flow rates are constant. Optimizing flow rates according to the invention is an optimization of a function of several variables (the flow rates in all the time intervals) rather than a classical control problem contemplated by the Pontryagin Maximum Principle. The solution exhibits a "bang bang behavior" with each control variable staying mainly at one bound or the other.

After considering this deterministic problem, a probabilistic description is created by assuming that the precise areal extent of the remaining oil is not known. An uncertainty such as this is affected by one or more numerical parameters which are referred to herein as uncertainty parameters. By appropriate averaging over multiple realizations, forming expectations by numerical integration, the expected NPV is maximized for a set of flow rates and a risk aversion constant. The probability distribution of the NPV and its uncertainty (i.e. the variance given the values of the control variables which optimize the mean) are also calculated. The results are then represented as probability distribution curves for the NPV and for total production (given that the flow rates are chosen to optimize the expected NPV). The probability distributions of the financial outcomes can then be calculated from the probability distributions describing the uncertain reservoir parameters. Efficient frontiers (similar to those described in Markowitz's theory of portfolio management) are then calculated by optimizing the linear combinations of the expected NPV and its standard (or semi-) deviation. Each point on the efficient frontier corresponds to a set of flow rates which will produce a maximum expected NPV with a given risk.

An iterative process for carrying out the invention includes the following steps.

(a) Choose a risk aversion constant K.

(b) Choose a set of flow rates.

(c) For each of certain chosen values of the uncertainty parameters, calculate and store an objective function (e.g. NPV).

(d) Calculate the mean and variance of the objective function set obtained in step (c) to obtain an objective function $F_K$ of the risk aversion constant, $F_K$ being a linear combination of semi-variance and mean NPV.

(e) repeat steps (b) through (d) until an optimal $F_K$ is found for the risk aversion constant K, (f) when the optimal $F_K$ is found for the risk aversion constant K, store the means and variances calculated in step (d), (g) repeat steps (a) through (f) for each risk aversion constant, and (h) generate an efficient frontier based on the set of means and variances stored in step (f).

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
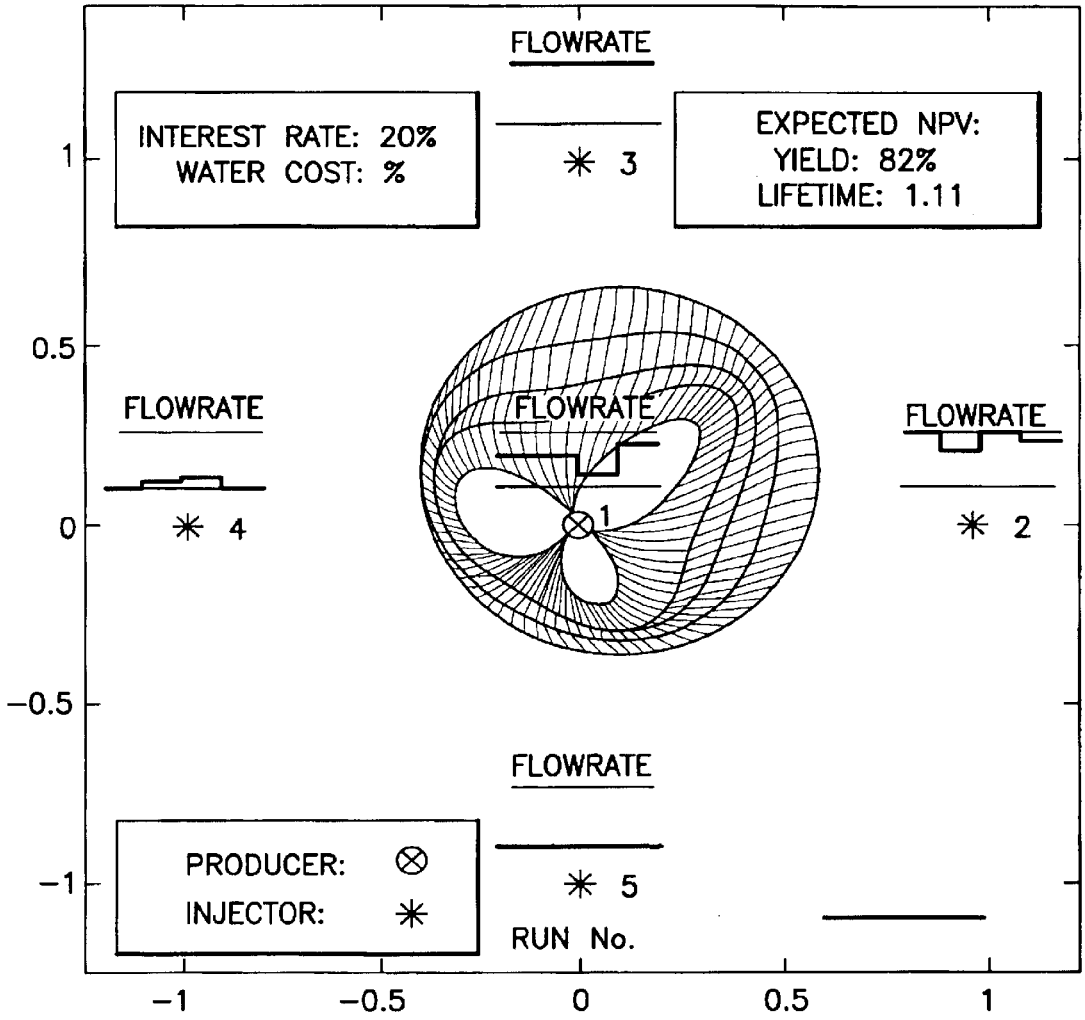
FIG. 1 is a schematic plan view of a five-spot well pattern showing the position of the oil-water interface and the flow rates at four intervals.

Referring now to FIG. 1, the methods of the invention include first deriving semi-analytical results for a model of the reservoir, making several assumptions. FIG. 1 illustrates an "inverted five-spot" pattern of wells in a reservoir with a producer well 1 in the center of a square defined by four injector wells 2–5. The model assumes that the initial oil-water interface is a circle with its center offset from the location of the producer well. The motion of the oil-water interface is illustrated at the end of four time intervals by the irregularly shaped lines inside the circle surrounding the production well. FIG. 1 also illustrates the assumed flow rates (pumping rates) of the five wells over the four time periods as compared to the upper and lower bounds of the flow rates. As seen in FIG. 1, the flow rates of wells 3 and 5 remain constant, with well 3 remaining high and well 5 remaining low. The flow rate of well 2 starts high, drops, goes high again, and drops slightly during the last interval. The flow rate of well 4 starts low, rises slightly twice, and then drops. The flow rate of the production well 1 stays the same for the first two intervals, drops, and then rises. During each time interval a permeable layer drapes an anticline and contains the water-driven, asymmetrically-shaped, pay zone containing oil. For purposes of this model, the oil and water are considered to have the same viscosity and the permeable layer is considered to have uniform thickness, porosity and permeability. The layer is considered to be so thin and flat that it is treated as horizontal and two-dimensional for the fluid flow calculations. The oil-water interface is considered to be sharp enough to be represented by a curve bounding the pay zone. In order to determine the NPV of the oil in the pay zone, it is necessary to determine the rate of production over time, the expected price of oil in the future and the discount rate. The first step in this calculation is to determine the movement of the oil-water interface based on the flow rates of the wells.

For a uniform isotropic medium, Darcy's law states that $v=-(\kappa/\mu)\nabla(p-\rho gz)$ where g is the acceleration due to gravity, z is the vertical ordinate increasing downward, $\rho$ and $\mu$ are density and viscosity common to the oil and water, $\kappa$ is the permeability of the porous rock, and p is fluid pressure. Assuming incompressibility of the fluids and constancy of $\kappa$ and $\mu$ with Darcy's law leads to Laplace's equation for the velocity potential $\psi$ ($v=\nabla\psi$), which is related to pressure p and depth z by $\psi=(\kappa/\mu)(\rho gz-p)$.

If attention is limited to two dimensions, as mentioned above, v and $\psi$ are independent of z in the thin permeable layer of constant vertical thickness h and the vertical component $v_3$ of velocity v is zero. With these assumptions $\psi$ and v ($v_1$, $v_2$) can be written as functions of horizontal location x, y, and time t. It is further assumed that the oil and water are contained in a circular region C (not shown in the drawing), having radius a, whose boundary will supply a water drive of constant hydraulic head.

The flow regime may be calculated very simply using the complex quantities w=x+iy and $w_k=x_k+iy_k$ for k=1, . . . , N, where the wells are located at horizontal positions $w_k$ with flux $q_k$ volume per unit time. It is assumed that $q_k>0$ for a producer well and $q_k<0$ for an injector well. Applying the Cauchy-Riemann equations, the complex velocity $\bar{v}=v_1-iv_2$ is given by Equation (1) where $q=(q_1, \ldots, q_N)$ is the vector of flow rates and there is an image well at $\bar{w}_k$, the point inverse to $w_k$ in the circle C.

$$\bar{v}(w, q) = \frac{1}{2\pi h}\sum_{k=1}^{N} q_k\left(\frac{1}{w-w_k} - \frac{1}{w-\bar{w}_k}\right) \tag{1}$$

Once the $q_k$ are chosen, each fluid particle moves along a trajectory w(t) satisfying Equation (2) where $\phi$ is the porosity, $$\dot{w} = \frac{1}{\phi}\overline{\bar{v}(w, q)} \tag{2}$$

Equation (2) represents a system of ordinary differential equations to be solved, one for each particle forming a discretization of the oil-water interface.

The flux functions $q_k(t)$ are regarded as control parameters. For producing wells $q_k>0$, for injectors $q_k<0$. In practive, the producer will penetrate the oil and an injector will penetrate the water outside the oil region. The pay-off function to be maximized is the discounted expected value of the oil produced over the lifetime of the producing well minus the expected discounted costs involved in operating the producer and injectors.

If it is assumed that well 1 is the single producer and wells 2 through N are injectors. The rate of production of oil at (future) time t is $q_1(t)$ and the present value of all oil produced is expressed as $$J_{pr} \equiv \int_0^{t_f} e^{-bt} r_1(t) q_1(t) dt \tag{3}$$

where $r_1(t)$ is the expected price of oil per barrel at time t, $t_f$ is the terminal time (the time at which water reaches the producer well) and b is the discount rate. If r(t) is set for all t to 1 and b is set to 0, then J reduces to the quantity of oil produced. It is also worth noting that if the expected price of oil rises at the discount rate b, then the product $e^{-bt}r_{pr}(t)$ remains constant. This is equivalent to, but has a different interpretation than, considering the NPV to be a financial derivative of the oil price. The terminal time $t_f$ is actually the first time water reaches some circle (e.g. the small circle indicating the well 1 in FIG. 1) of small radius $\delta$ centered on the producer. This is regarded for argument's sake as the well radius. It is some small radius within which it is not safe to allow water. Similar considerations apply to the injectors and an expression $J_{inj}$ similar to Equation (4) is obtained. Assuming that $r_k(t)$ (k=2, . . . N) is the cost to inject a unit volume of water into well k, and that $r_2=r_3= \ldots =r_N \neq r_1$, the total payoff is expressed as $$J \equiv J_{pr} - J_{inj} = \sum_{K=1}^{N} \int_0^{t_f} e^{-bt} r_k(t) q_k(t) dt \tag{4}$$

where the sign of $q_k$ corrects for the difference between costs of the injector wells and the gain of the producer well.

The next step in the determination is to maximize J subject to the dynamics of the oil-water interface. Because of the simplifying assumptions made above, the oil-water interface w(t,$\theta$) may be regarded as a parametized closed contour of fluid particles in the w=x+iy plane which moves according to the velocity field of Equations (1) and (2) with initial values $w(0,\theta)=w_0(\theta)$ where $w=w_0(\theta)$ is the equation of the oil-water interface at t=0 in parametric form. The terminal time $t_f$ can then be expressed as a function of the $q_k$ by $$t_f = sup\{t|\forall\theta|w(t,\theta)|\geqq\delta\} \tag{5}$$

Numerically, $\theta$ will be discretized as $\theta_1, \theta_2, \ldots, \theta_N$, and the system of ordinary differential equations obtained by considering all of these values of $\theta$ simultaneously will be solved.

It is assumed that the $q_k$ are stepwise constant functions of t but vary with k. Then J is differentiable with respect to the $q_k$ except for those values of $q_k$ for which there is more than one value of i for which $|w(t_f, \theta_i)=\delta$. That is when more than one fluid particle arrives simultaneously at the distance $\delta$ from the producer.

The optimization problem may now be expressed as Expression (6), the maximization of J(q) over q subject to various constraints including the equations of interface motion, the initial location of the interface particles, and the bounds on well flow rates, i.e. Equations (7) and (8) and Inequality (9).

$$\max_{q(\cdot)} J(q) \tag{6}$$

$$\frac{dw(t, \theta)}{dt} = f[w(t, \theta), q(t)] \tag{7}$$

$$w(0)=w_0 \tag{8}$$

$$v_{lb} \leqq q(t) \leqq v_{ub} \tag{9}$$

Referring once again to FIG. 1, the time interval (0, $t_f$) has been divided into four equal subintervals. The position of the oil-water interface at the end of each interval is shown by the irregularly shaped heavy lines surrounding the producer well 1. The lighter lines flowing towards the producer well represent particle paths for some fluid particles on the oil-water interface. As shown in FIG. 1, three "fingers" of water approach the well simultaneously. The number of fingers is related to the number of injector wells, but the relationship is not simple. Because the pumping rates of some of the wells are against their bounds in several time intervals, the number of degrees of freedom in the controls is reduced. If the flow rates are not optimized as described thus far, one "finger" will approach the producer first and water will enter the well before the maximum amount of oil has been produced.

The optimization thus far does not account for uncertainties. There are uncertainties regarding the accuracy of the assumptions made about the reservoir even when using a sophisticated reservoir simulator rather than the oversimplified model given by way of example, above. Further, there are financial uncertainties such as the volatility of the price of oil and prevailing interest rates. Under extreme circumstances, e.g. a fixed oil price and interest rate, one could maximize profit with arbitrage. That is, one could short sell oil, deposit the proceeds in an interest bearing account, then buy the oil back later and pocket the interest. In reality, oil price is stochastic and the NPV should be treated as a derivative of the oil price since it is explicitly tied to the oil price.

One way to solve for NPV when oil price volatility is introduced is to use a binomial lattice such as that described by Luenberger, D. G., Investment Science, Oxford University Press, New York (1998). In such a lattice (or tree) there are exactly two branches leaving each node. The leftmost node corresponds to the initial oil price S. The next two vertical ("child") nodes represent the two possibilities at time $\Delta t$ that the oil price will either go up to $S_u \equiv uS$ or down to $S_d \equiv dS$, where $u=Re^{\sigma\sqrt{\Delta t}}$ and $d=Re^{-\sigma\sqrt{\Delta t}}$. Here $\sigma$ is the volatility and $R \equiv e^{b\Delta t}$ is the risk-free discount factor. The binomial lattice process is used to build a tree of oil prices until time $t_f$. Requiring no arbitrage, one can calculate the value of any derivative of the oil price at each node of the lattice working backward in time as in a dynamic programming problem. Taking into account the production in the interval $\Delta t$, a certain combination of the oil asset S and its derivative J at the parent node will have equal values at each child node, and the "no arbitrage" condition requires that this risk-free combination earn the risk-free rate of interest as set out in Equations (10) and (11) where J is the NPV at the parent node and $J_i$ are the NPVs at the child nodes combined with the new contributions from the production within the interval $\Delta t$.

$$V_u-\alpha S_u=V_d-\alpha S_d=R(J-\alpha S) \tag{10}$$

$$V_i = J_i + \Delta t\left(S_i q_1 + \sum_{k=2}^{N} r_k q_k\right), \quad i = u, d \tag{11}$$

It will be appreciated that S in Equations (10 and (11) corresponds to r in previous equations and the sign convention discussed above applies to these equations as well.

Solving Equation (10) for $\alpha$ and J yields: $J \equiv (p_u V_u + p_d V_d)/R$, where $P_u \equiv (R-d)/(u-d)$ and $p_d \equiv (u-R)/(u-d)$ are the so-called "risk-neutral probabilities". It should be noted that $p_u S_u + p_d S_d = RS$. From the above and Equation (11), the NPV J at a given node of the lattice can be expressed by means of Equation (10) as.

$$J = \frac{1}{R}\left[p_u J_u + p_d J_d + \Delta t\left(RSq_1 + \sum_{k=2}^{N} r_k q_k\right)\right] \tag{12}$$

As mentioned above, the complete solution process involves applying Equation (12) at each node running backwards from the most future child node to the present parent node to obtain the NPV corresponding to the initially set oil price. Equation (12) is similar to a financial derivative called a "forward contract" in each subinterval of the lattice. This calculation assumes that oil production is uninterrupted no matter how much the oil price drops. However if the expression in parentheses in Equation (12) becomes negative, it means that the cost of water injection outweighs the income from oil production. In that case, one could calculate the NPV based on the option not to produce during that time interval where production is unprofitable. This calculation is accomplished by adding the expression in parentheses only when it is positive and not producing when it is negative.

The foregoing discussion of uncertainty calculations concerns financial uncertainties. As mentioned above, there are also uncertainties regarding the reservoir. As a simple example, it is assumed that the initial radius of a circular oil patch is random with a known probability distribution. Taking nine realizations of the radius, equally spaced in probability, the expected values are formed by replacing integrals over the probability space with sums of quantities over the nine radii. In order to simplify computations for this example, it is assumed that the values $q_k$ are constant in time, i.e. there is only one time interval, unlike the step function of $q_k$ described earlier. This simplification allows the computations to be run backwards from the final radius $\delta$ around the producer and consider when the various fluid particles reach the nine realizations of the circular boundary of the oil. This obviates the need for running the computations forward nine times for each iteration during optimization. The time $t_f$ is the same in the forward and backward computations. For each set of $q_k$, k=1, . . . , N, there are nine events corresponding to the first crossing of each of the nine circles by one of the fluid particles. Each event defines a $t_f$ and a corresponding index of the fluid particle which first reaches the corresponding circle. For each of the nine realizations, the NPV (or other objective function) is calculated and the mean value of the nine results is also calculated. As a final step, the optimal values of the $q_k$ are used to make forward calculations of the nine realizations and the resulting evolution of the oil-water interface is plotted. In view of the foregoing, those skilled in the art will appreciate that, in the backward integration, it is easy to compute other quantities of interest such as the total volume of oil produced and the variances of other quantities.

Figure 2:
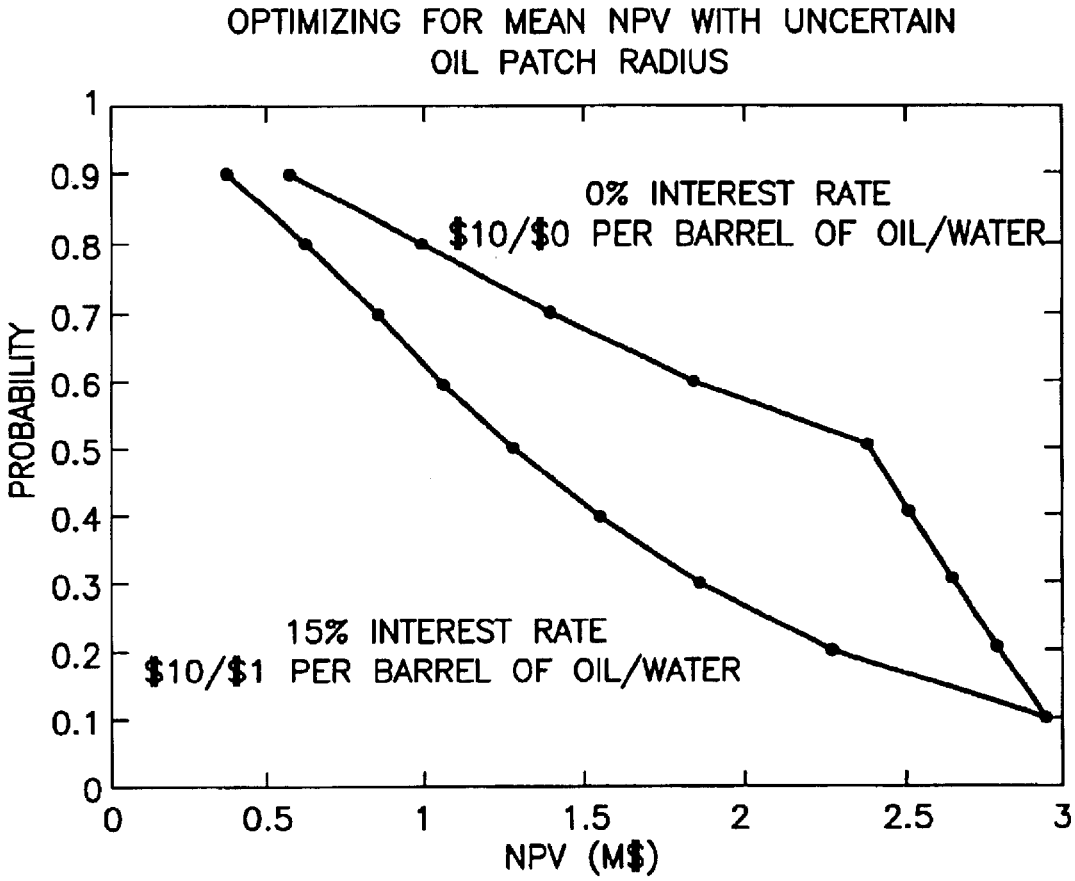
FIG. 2 is a graph illustrating the probability of NPV for two sets of parameters.
Figure 3:
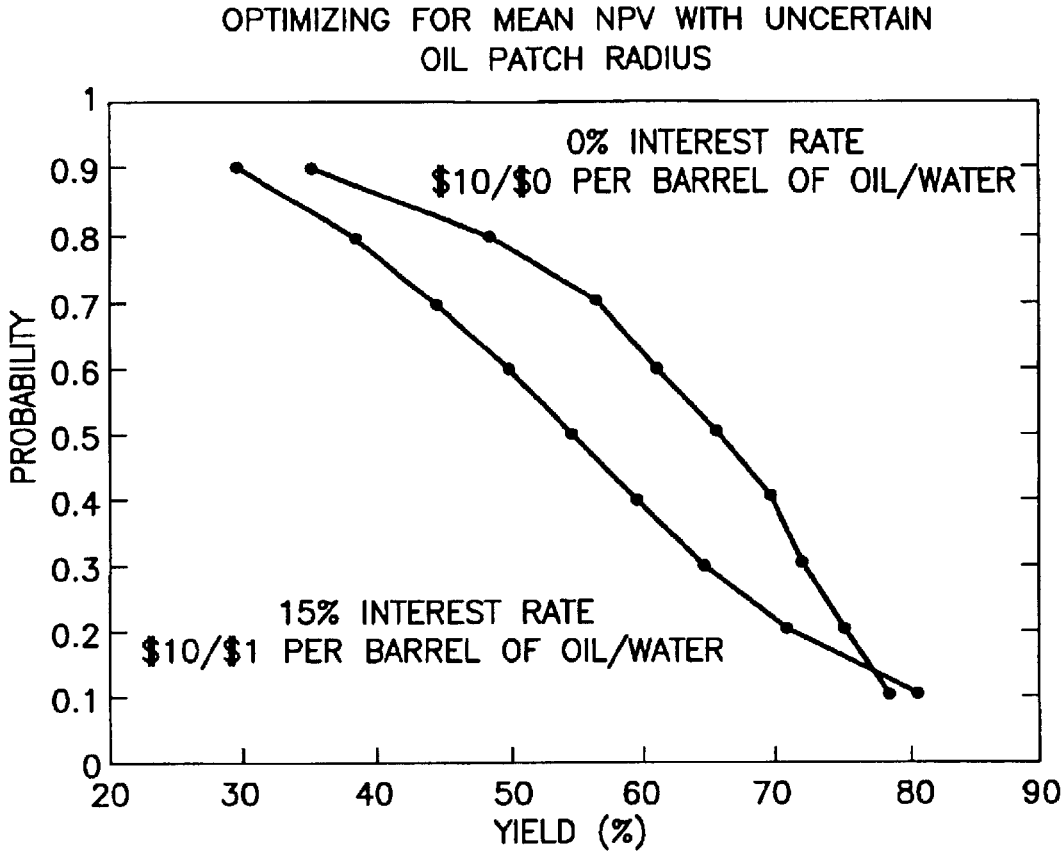
FIG. 3 is a graph illustrating the probability of obtaining percentage yields for two sets of parameters.
Figure 4:
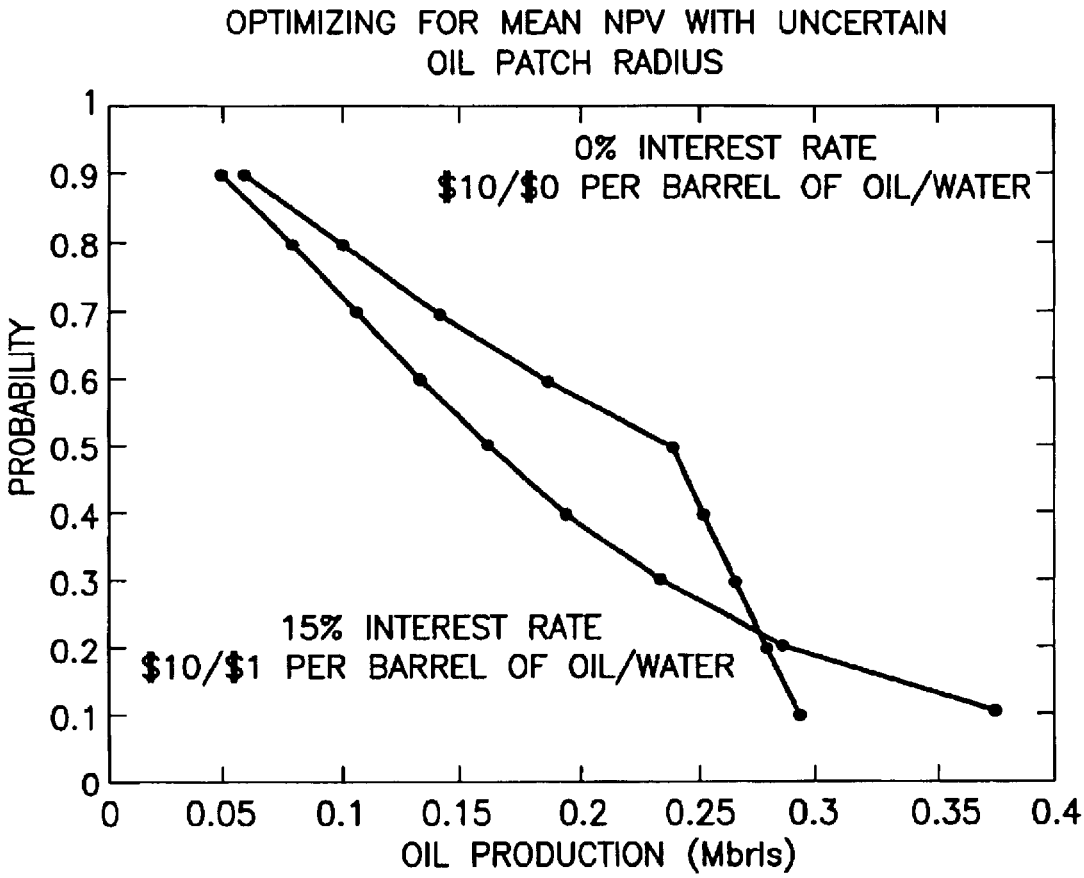
FIG. 4 is a graph illustrating the probability of obtaining volume of oil for two sets of parameters.

FIGS. 2–4 were obtained by optimizing the NPV in two cases. The upper plot in each figure uses quantities $q_k$ which are optimal when the interest rate and the cost of pumping water are both zero and the price of oil is \$10/bbl. Thus, the NPV is directly related to the volume of oil produced. The lower plot in each figure uses quantities $q_k$ which are optimal when the interest rate is 15%/yr and the cost of pumping water is \$1/bbl.

FIG. 2 plots the probability on the vertical axis of obtaining at least the NPV on the horizontal axis. Using the same values $q_k$, FIG. 3 plots the probability on the vertical axis of obtaining at least the yield (ratio of oil produced to total oil in reservoir) on the horizontal axis as a percentage; and FIG. 4 plots the probability on the vertical axis of obtaining at least the total production on the horizontal axis. Although these functions take uncertainty into account, they do not take into account the downside risk of choosing a particular set of values $q_k$.

According to the methods of the invention, theories of portfolio management have been applied to the problems discussed thus far. In particular, the invention utilizes aspects of Markowitz's modern portfolio theory. See, Markowitz, H. M., "Portfolio Selection", 1959, Reprinted 1997 Blackwell, Cambridge, Mass. and Oxford, UK.

According to the invention, the standard deviation $\sigma$ sand mean $\alpha$ of an objective function F are used in conjunction with a risk aversion constant $\lambda$ in order to optimize F for each $\lambda$. In the case of a linear combination, for example, Equation (13) is maximized for each value of $\lambda$ where $0<\lambda<1$.

$$F_\lambda=(1-\lambda)\mu-\lambda\sigma \tag{13}$$

If $\lambda=0$, the solution will be the maximum mean regardless of the risk or the standard deviation. If $\lambda=1$, the solution will be the minimum risk regardless of the mean. If the maximum of $F_\lambda$ is denoted $F_\lambda^{max}$, then the $F_\lambda$ of Equation (13) for each possible set of values of the control will be less than or equal to $F_\lambda^{max}$ and the possible values of $\sigma$ and $\mu$ must lie in the convex set formed by the intersection of half-planes defined by Equation (14).

$$F_\lambda^{max} \geqq (1-\lambda)\mu - \lambda\sigma \tag{14}$$

Figure 5:
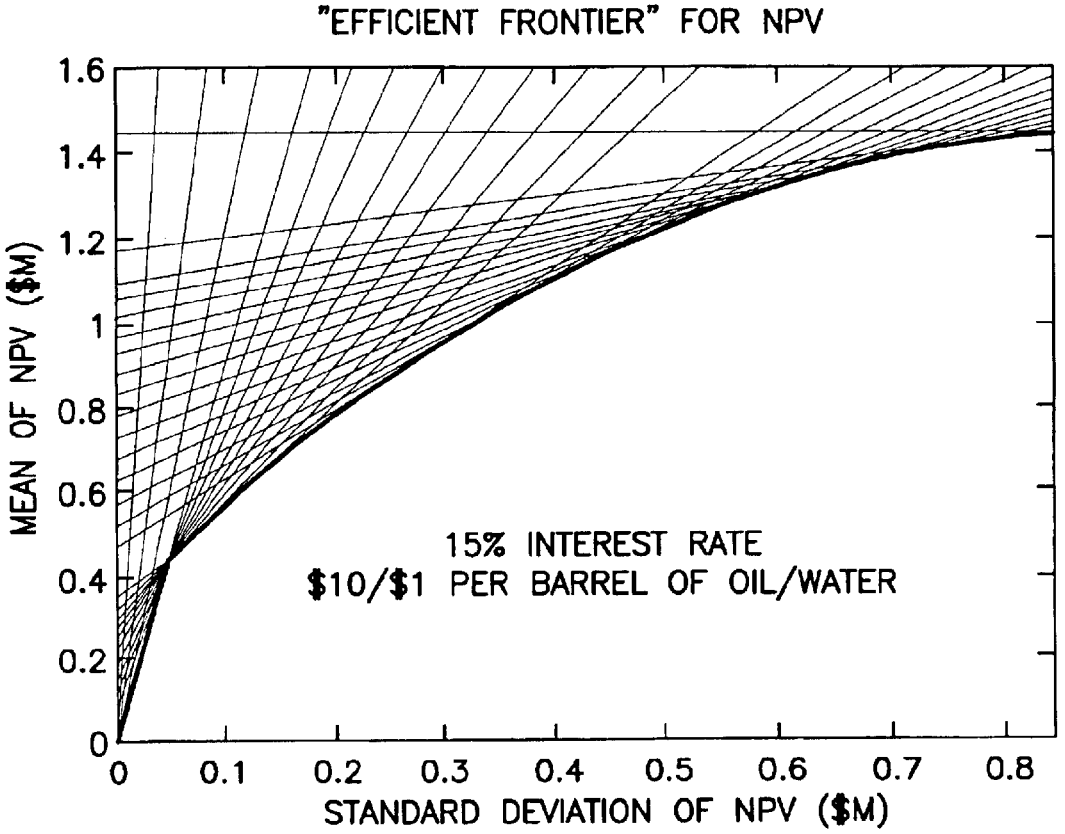
FIG. 5 is a graph illustrating the efficient frontier for NPV based on standard deviation.

Equation (14) is represented in FIG. 5 where F is the NPV. The vertical axis of FIG. 5 represents expected mean NPV and the horizontal axis represents the minimum risk associated with the expected NPV. The solution of Equation (14) includes the set of points above the dark line (the intersection of half-planes) as well as the dark line itself. The set of points above the line include all of the sets of $q_k$ which satisfy Equation (14). The dark line is the "efficient frontier" which is the optimal solution for maximizing NPV for a given risk or minimizing risk for a given NPV. The data used to construct FIG. 5 are taken from the four injector, one producer example given above where the actual volume of oil initially in place is uncertain and there is a requirement that no water be produced at the producer well. Each point in the efficient frontier corresponds to a unique $\lambda$ via the multi-well flow rate schedule that optimizes $F_\lambda$. That schedule then determines the corresponding point $(\mu_\lambda,\sigma_\lambda)$ on the efficient frontier. Thus, the efficient frontier can be thought of simply as the locus of $F_\lambda$, i.e., the set of all points $(\mu_\lambda,\sigma_\lambda)$ whose location is determined by the flow rates that optimize $F_\lambda$.

In order to substantially eliminate the downside risk, the efficient frontier can be refined by using the one-sided semi-deviation rather than the standard deviation. The semi-deviation $\sigma^-$ is defined by $$(\sigma^-)^2 = E\{[\min(F-\mu,0)]^2\} \tag{15}$$

where E{ } represents the expected value of the expression in the braces.

Figure 6:
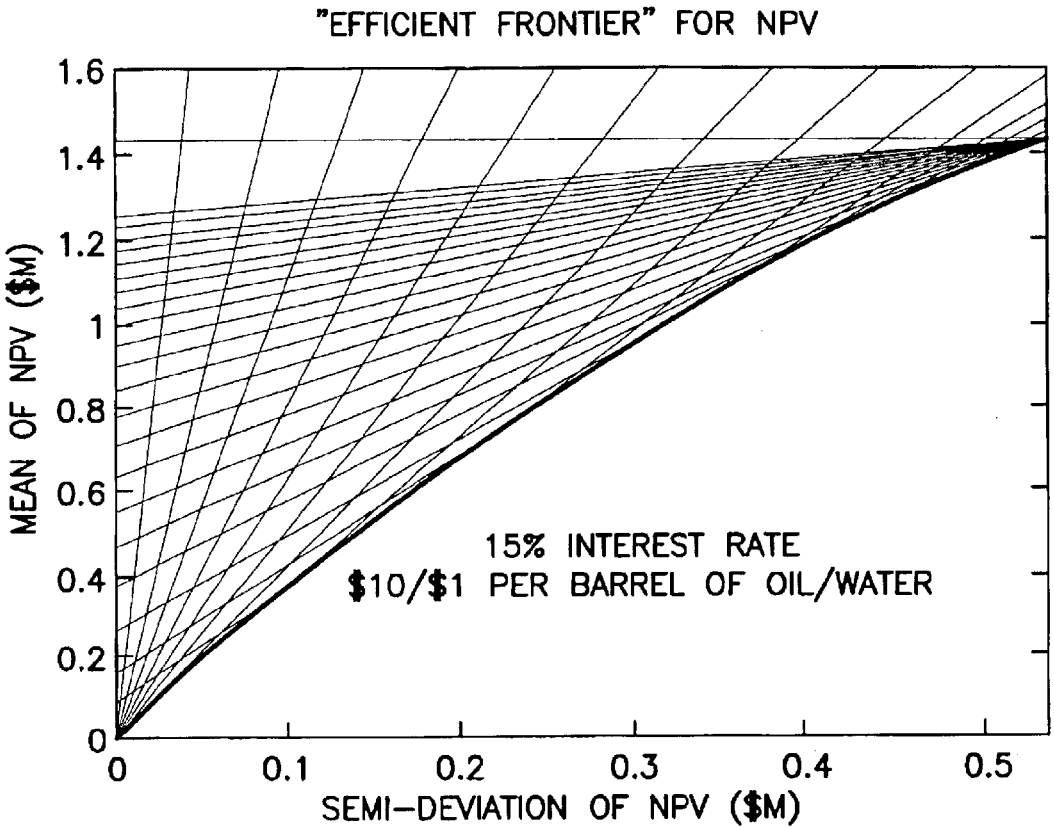
FIG. 6 is a graph illustrating the efficient frontier for NPV based on semi-deviation.

The efficient frontier based on the semi-deviation is illustrated in FIG. 6.

Figure 7:
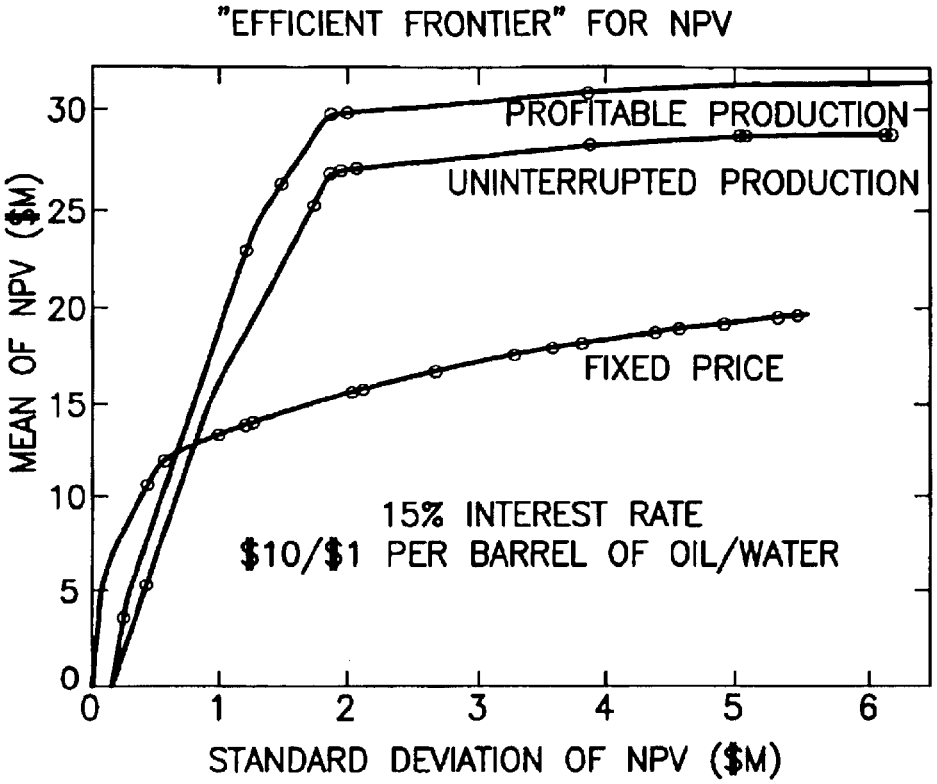
FIG. 7 is a graph illustrating the efficient frontier for NPV based on standard deviation for three sets of parameters.

Other examples of efficient frontiers are illustrated in FIG. 7 which shows the efficient frontiers for three different treatments of the oil price.

Figure 8:
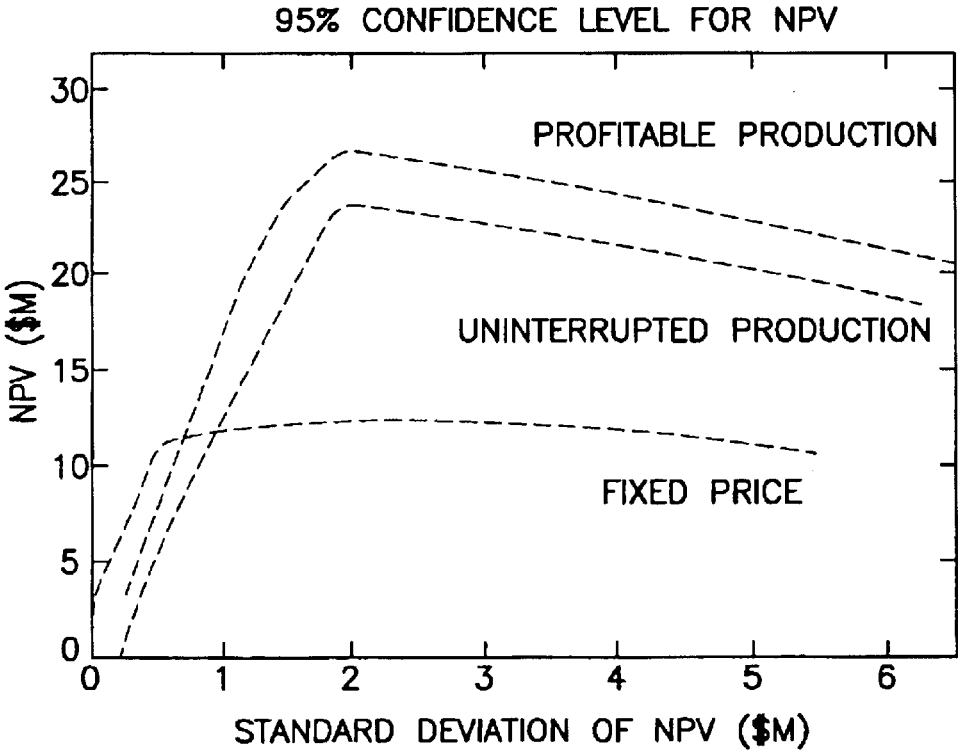
FIG. 8 is a graph illustrating the 95% confidence level for NPV corresponding to the efficient frontiers in FIG. 7, assuming NPV is normally distributed.

FIG. 8 illustrates the 95% confidence level for the efficient frontiers of FIG. 7 assuming that the NPV is normally distributed.

The efficient frontier can also be modified by redefining the risk constant as $0 \leqq K < \infty$ and defining $F_K$ as $$F_K = \mu - K\sigma \tag{16}$$

In this case K takes on a more significant meaning than $\lambda$. For example, if some quantity X (e.g. NPV, total oil produced, etc.) results from a process with uncertainties, X will have a probability density function inherited from the uncertainty of the underlying process. Assuming that X has a probability distribution with a mean $\mu$ and a variance $\sigma^2$, using these values, and assuming that $F_K$ of Equation (16) is optimized, it is possible to compute the probability that $X>F_K$. Another way of stating this is to say with what confidence (in percent) can one be certain that X will be greater than $F_K$. From probability theory, this probability can be expressed as $$P(X>F_K) \equiv 1-P(X \leqq F_K) = n/100 \tag{17}$$

Equation (17) is equivalent to Equation (18) where $\Phi$ is the normalized distribution function for X.

$$1-\Phi\left(\frac{F_K-\mu}{\sigma}\right) = 1-\Phi(-K) = \frac{n}{100} \tag{18}$$

For distributions having the property $\Phi(-z)=1-\Phi(z)$ for all z, including z with densities symmetric about the mean, Equation (18) can be reduced to $$\Phi(K) = \frac{n}{100} \tag{19}$$

Using the inverse distribution function to solve for K in Equation (18), the general case, yields Equation (20) and solving for Equation (19), for symmetrical distributions, yields Equation (21).

$$K = -\Phi^{-1}\left(1-\frac{n}{100}\right) \tag{20}$$

$$K = \Phi^{-1}\left(\frac{n}{100}\right) \tag{21}$$

Substituting for $F_K$ yields Equation (22) for the general case and Equation (23) for symmetric distributions.

$$F_K = \mu + \sigma\Phi^{-1}\left(1-\frac{n}{100}\right) \tag{22}$$

$$F_K = \mu - \sigma\Phi^{-1}\left(\frac{n}{100}\right) \tag{23}$$

In applied statistics, $-\Phi^{-1}(1-n/100)$ is called the upper n-percentile and Equations (22) and (23) correspond to Equation (16). Thus, one may interpret Equation (20) as the upper n-percentile of the value $F_K$ that is, with the probability of n/100 that X will be greater than $F_K$.

The methods described thus far can be generalized to include various combinations of statistical parameters other than linear equations. Parameters other than the mean can be used to search for an optimum. For example, the median or the mode (for discrete-valued forecast distributions where distinct values might occur more than once during the simulation) may be used as the measure of central tendency. Further, instead of the standard deviation, the variance, the range minimum, or the low end percentile could be used as alternative measures of risk or uncertainty.

Figure 9:
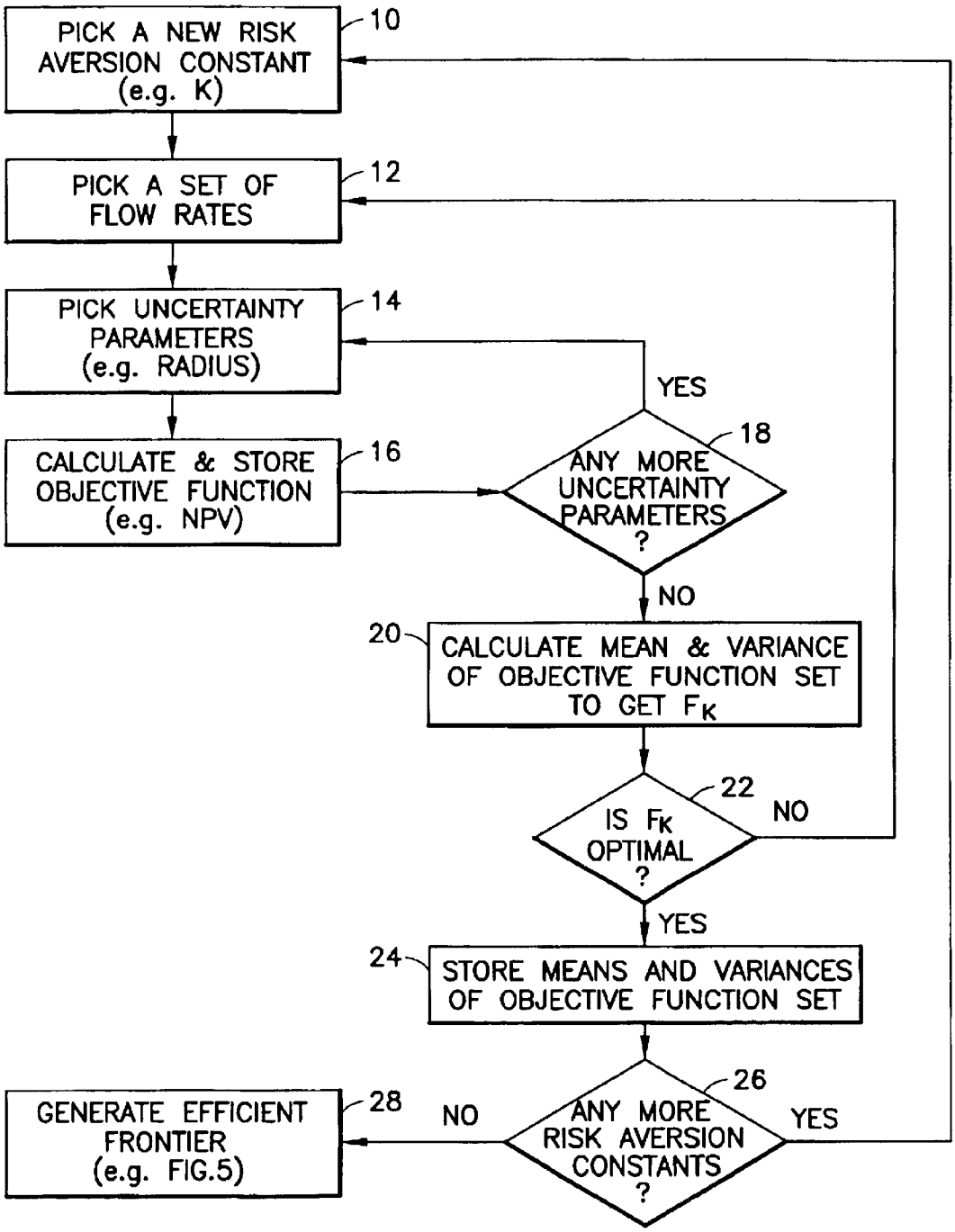
FIG. 9 is a flow chart illustrating an iterative process according to the invention.

Turning now to FIG. 9, an iterative process for carrying out the invention includes the following steps: At 10, a risk aversion constant K is chosen. At 12, a set of flow rates is chosen. At 14, a value or values for all uncertainty parameters is chosen. At 16, an objective function is calculated and stored. Then, at 18, a determination is made as to whether there are more uncertainty parameter values to be considered. If there are, steps 14 and 16 are repeated for each value of the uncertainty parameters until it is determined at 18 that there are no more uncertainty parameter values to be considered. When there are no more uncertainty parameter values for this set of flow rates, the mean and variance of the objective function set obtained in step 16 are calculated to obtain an objective function $F_K$ of the risk aversion constant and flow rates. It is then determined at 22 whether the function $F_K$ is optimal. If it is not optimal steps 12 through 22 are repeated until the optimal $F_K$ is found at 22. When the optimal $F_K$ is found for the risk aversion constant K, the means and variances calculated in step 20 are stored at 24. A determination is made at 26 whether there are more risk aversion constants. If there are, steps 10 through 24 are repeated for each risk aversion constant. When it is determined at 26 that there are no more risk aversion constants, an efficient frontier is generated at 28 based on the set of means and variances stored at step 24.

There have been described and illustrated herein several embodiments of methods for optimization of oil well production with deference to reservoir and financial uncertainty. While particular embodiments of the invention have been described, it is not intended that the invention be limited thereto, as it is intended that the invention be as broad in scope as the art will allow and that the specification be read likewise. Thus, while particular objective functions (i.e. NPV and production quantity) have been disclosed, it will be appreciated that other objective functions could be utilized. Also, while specific uncertainty parameters (i.e. radius of the oil patch, cost of oil, and interest rate) have been shown, it will be recognized that other types of uncertainty parameters could be used. Furthermore, additional parameters could be used, including the number of wells taking into account the cost of drilling each well. The use of an exploration well could be used to better determine the probability distribution of the location of the oil. Also, those skilled in the art will appreciate that the optimization methods of the invention may be applicable to stochastic processes other than oil well production. It will therefore be appreciated by those skilled in the art that yet other modifications could be made to the provided invention without deviating from its spirit and scope as so claimed.

What is claimed is:

1. A method for optimizing production in an oil field having at least one production well and at least one injection well where production is subject to a plurality of uncertainty parameters and a plurality of risk aversion constants, said method comprising:

a) choosing a risk aversion constant K;

b) choosing a set of flow rates for the production well(s) and injection well(s);

c) for each uncertainty parameter value, calculating and storing an objective production function;

d) calculating the mean and variance of the objective function set obtained in step (c) to obtain an objective function $F_K$ of the risk aversion constant chosen in step (a);

e) repeating steps (b) through (d) until an optimal $F_K$ is found for the risk aversion constant K chosen in step (a);

f) storing the means and variances calculated in step (d), when the optimal $F_K$ is found for the risk aversion constant K chosen in step (a);

g) repeating steps (a) through (f) for each risk aversion constant;

h) generating an efficient frontier based on the set of means and variances stored in step (f); and i) optimizing production by setting the flow rate for the production well(s) and the injection well(s) based on the efficient frontier.

2. A method according to claim 1, wherein:

the objective production function calculated in step (c) is chosen from the group consisting of net present value of the oil field, quantity of oil produced, and percentage yield.

3. A method according to claim 1, wherein:

the objective function calculated in step (c) is $$J_{pr} \equiv \int_0^{t_f} e^{-bt} r_1(t) q_1(t) dt$$

where $J_{pr}$ is net present value of the oil produced, t is time, $t_f$ is the time production ceases, b is the discount rate, $r_1(t)$ is the expected price of oil per barrel at time t, and $q_1(t)$ is the rate of production at time t.

4. A method according to claim 1, wherein:

the objective function calculated in step (c) is $$J \equiv J_{pr} - J_{inj} = \sum_{k=1}^{N} \int_0^{t_f} e^{-bt} r_k(t) q_k(t) dt$$

where J is the total payoff, N is the number of wells, t is time, b is the discount rate, $r_k(t)$ is the expected cost to inject water into well k at time t, and $q_k(t)$ is the rate of production at time t.

5. A method according to claim 1, wherein:

$F_K=(1-K)\eta-K\sigma$, where $\eta$ is the mean and $\sigma$ is the standard deviation.

6. A method according to claim 1, wherein:

the variances calculated in step (d) are based on $(\sigma^-)^2=E\{[\min(F-\eta,0)]^2\}$, where $\sigma^-$ is the semi-deviation, E{ } represents the expected value of the expression in the braces, and $\eta$ is the mean.

7. A method according to claim 1, wherein:

$$F_K = \mu + \sigma\Phi^{-1}\left(1 - \frac{n}{100}\right)$$

where $\mu$ is the mean, $\sigma$ is the standard deviation, and $\Phi$ is a normalized distribution function of the objective production function.

8. A method according to claim 1, wherein:

$$F_K = \mu - \sigma\Phi^{-1}\left(\frac{n}{100}\right)$$

where $\mu$ is the mean, $\sigma$ is the standard deviation, and $\Phi$ is a normalized distribution function of the objective production function.

* * * * *